US010322490B2

(12) United States Patent
Flores et al.

(10) Patent No.: US 10,322,490 B2
(45) Date of Patent: Jun. 18, 2019

(54) METHOD AND DEVICE FOR PRODUCING NON-CYLINDRICAL BORES WITH AT LEAST ONE RECESS BY HONING

(71) Applicant: Gehring Technologies GmbH, Ostfildern (DE)

(72) Inventors: Gerhard Flores, Ostfildern (DE); Erwin Baumgartner, Osfildern (DE); Manuel Waiblinger, Stuttgart (DE); Andreas Wagner, Denkendorf (DE)

(73) Assignee: Gehring Technologies GmbH, Ostfildern (DE)

( * ) Notice: Subject to any disclaimer, the term of this patent is extended or adjusted under 35 U.S.C. 154(b) by 286 days.

(21) Appl. No.: 15/331,827

(22) Filed: Oct. 22, 2016

(65) Prior Publication Data

US 2017/0129070 A1 May 11, 2017

(30) Foreign Application Priority Data

Nov. 5, 2015 (DE) ..... 10 2015 221 714

(51) Int. Cl.
*B24B 33/08* (2006.01)
*B24B 33/02* (2006.01)
(Continued)

(52) U.S. Cl.
CPC ..... *B24B 33/04* (2013.01); *B24B 33/025* (2013.01); *B24B 33/06* (2013.01); *B24B 33/081* (2013.01);
(Continued)

(58) Field of Classification Search
CPC .... B24B 5/06; B24B 5/08; B24B 5/10; B24B 5/185; B24B 5/40; B24B 33/02;
(Continued)

(56) References Cited

U.S. PATENT DOCUMENTS 2,304,930 A * 12/1942 Klein ..... B24B 33/08 451/474
2,777,257 A * 1/1957 Johnson ..... B24B 33/06 33/DIG. 2
(Continued)

FOREIGN PATENT DOCUMENTS

DE 34 47 361 7/1986
DE 36 10 738 10/1987
(Continued)

*Primary Examiner* — Timothy V Eley
(74) *Attorney, Agent, or Firm* — Gudrun E. Huckett

(57) ABSTRACT

A honing tool has a tool body and shells disposed on the tool body. Honing stone sets each provided with two or more honing stones are provided. The shells each support one of the honing stone sets. Guide bars of the honing tool are placed against the bore and a portion of the bore is conically honed with decreasing stroke of the honing tool, wherein a lower reversing point of the honing tool remains substantially unchanged. Honing is terminated as soon as an upper reversing point has reached a predetermined terminal value. Alternatively, a portion of the bore is conically honed with a constant stroke of the honing tool, wherein reversing points of the stroke of the honing tool remain substantially unchanged and a feeding force pressing the honing stones against the bore is controlled as a function of a position of the honing tool in the bore.

31 Claims, 15 Drawing Sheets

(51) Int. Cl.
*B24B 33/06* (2006.01)
*B24B 33/04* (2006.01)

(52) U.S. Cl.
CPC ..... *B24B 33/083* (2013.01); *B24B 33/087* (2013.01); *B24B 33/088* (2013.01)

(58) Field of Classification Search
CPC ..... B24B 33/022; B24B 33/025; B24B 33/06; B24B 33/083; B24B 33/087; B24B 33/088
See application file for complete search history.

(56) References Cited

U.S. PATENT DOCUMENTS 3,369,330 A * 2/1968 Estabrook ..... B24B 33/083 451/476
4,434,588 A * 3/1984 Wada ..... B24B 33/083 451/462
5,177,904 A * 1/1993 Nagel ..... B24B 33/06 451/156
5,269,103 A * 12/1993 Nagel ..... B24B 33/087 451/27
5,564,968 A * 10/1996 Werner ..... B24B 33/083 451/462
6,960,121 B2 11/2005 Klink et al.
8,292,695 B2 10/2012 Flores et al.
8,500,988 B2 * 8/2013 Lin ..... B24B 33/02 205/640
10,086,491 B2 * 10/2018 Baumgartner ..... B24B 33/083
2016/0303702 A1 10/2016 Xavier et al.

FOREIGN PATENT DOCUMENTS

DE 103 58 150 7/2005
DE 10 2010 032 453 2/2012
DE 10 2012 009 110 10/2013
DE 10 2013 204 714 10/2014
DE 10 2015 209 609 12/2016
EP 0 569 926 11/1993
EP 2 170 556 4/2010
GB 722 327 1/1955

* cited by examiner (1st alternative)

(2nd alternative)

METHOD AND DEVICE FOR PRODUCING NON-CYLINDRICAL BORES WITH AT LEAST ONE RECESS BY HONING

BACKGROUND OF THE INVENTION

The invention relates to a process chain for machining an initially cylindrical bore by honing tools as well as to the corresponding honing tools.

The manufacturers of motor vehicles are faced with the permanent task of continuously reducing the fuel consumption of their vehicle fleet furnished with reciprocating piston engines. In reciprocating piston engines, the friction between the piston or the piston rings, on the one hand, and the cylinder bore plays a great part in the internal friction losses up to about 35%. Therefore, the reduction of friction in the area of the cylinder bore provides a significant potential for reducing the fuel consumption.

An approach for reducing the friction between piston and cylinder bore is form honing, developed by the applicant, that is disclosed in detail in EP 2 170 556 B1. In this method, the deviations from the geometry of a cylinder that are caused by clamping actions during assembly and/or thermal expansions of the cylinder bore are equalized in that complementary elevations or depressions are formed during form honing. This method is very effective and is used successfully in the production of various reciprocating piston engines.

DE 10 2013 204 714 A1 discloses a honing method by means of which the cylinder bore of an internal combustion engine is provided with a bottle shape. A shape in which the cylinder bore has two cylindrical sections that have a different diameter is referred to as bottle shape. The section with the smaller diameter is provided in the area of the cylinder head while the section with the greater diameter is provided in the area of the crankshaft. Between these areas, a truncated cone-shaped transition area is formed which occupies approximately 5% to 20% of the bore length.

DE 103 581 50 A1 discloses a method with which two sections of different hardness that are sequentially arranged in axial direction of a cylinder bore can be machined. This method and the corresponding tool are in particular advantageously employed when the cylinder bore is hardened in sections thereof and, as a consequence, the hardened section and section that is not hardened must be honed in a different way.

From this publication it is known to design the cylinder bore at its open end, i.e., where later on the cylinder head is mounted, such that a counterbored bore results. This is graphically illustrated in FIG. 6 of this publication. A slight widening in the upper section of the cylinder bore is referred to as a counterbore. In this context, this widening only applies to the uppermost quarter of the cylinder bore.

A further approach for reducing the friction between piston rings and cylinder running surface provides widening of the cylinder bore at the end that is located in the vicinity of the crankcase. This end is also referred to in the following as "bottom end". The later published DE 10 2015 109 609 discloses a process chain for widening (cylinder) bores at their bottom end. For this purpose, relatively short honing stones are employed.

In order to reduce the pump losses of internal combustion engines, the cylinders of internal combustion engines of the newest generation have one or more recesses at their bottom end. These recesses reduce the pump losses. However, they lead to the honing process being carried out with an interrupted cut. The tools known from the prior art with short honing stones that are suitable for widening a bore cannot be used in bores with a recess because the short honing stones have the tendency to cant when they "travel across" the recess.

The invention has the object to provide honing methods, a process chain as well as suitable honing tools for performing the methods which allow for the inexpensive and reproducible manufacture of widened cylinder bores with at least one recess. This widening is referred to also as "conical honing".

In this context, the desired geometry of the "cylinder bore" is a cylindrical section with an adjoining conically widened end. Possibly, the bore also comprises one or two additional cylindrical sections. A truncated cone-shaped (cylinder) bore in the meaning of the invention is a bore whose diameter changes continuously across more than half of the length, preferably at least ¾ of the length of the cylinder bore. Ideally, the truncated cone occupies more than 85%, in some cases even 100%, of the length of the cylinder bore.

SUMMARY OF THE INVENTION

This object is solved according to the invention by a tool comprising a tool body comprising several honing stones and characterized in that two or more honing stones are arranged on a common shell.

The tool according to the invention is characterized in that two, three, or four or even five honing stones are arranged on a common shell. The honing stones which are arranged adjacent to each other on the shell in circumferential direction of the honing tool cover an angle range of the bore to be machined of, for example, 30° or 50° and are connected to each other more or less rigidly. When such a group of short honing stones now travels across a recess in the bore to be machined, wherein the width of the recess is smaller than the circumferential range that a shell or the honing stones arranged adjacent to each other on the shell covers, canting of the honing stones in the area of the recess is effectively avoided.

As a result of this, it is possible to design the honing stones to be very short and to produce a conicity or widening of the bore even where the recess is located.

Because canting of the short honing stones when traveling across the recess is reliably prevented by the arrangement according to the invention of several honing stones on one shell that is bridging the recess, the stock removal rate of the honing tool according to the invention is very high even for widening or plateau honing of bores with recesses.

The tool according to the invention is of a very compact configuration because, due to the arrangement of several honing stones on a shell, the number of components is relatively minimal. In particular, the tool length is relatively short and, moreover, the tool according to the invention requires only a minimal idle travel past the bore to be machined so that the tool can be used even when tight space conditions are present, for example, because the the bearing seat of a crankcase occupies space.

In order for the honing stones of the tool according to the invention, which serve for conical honing of a section of a cylindrically pre-honed bore, to be centered in the best possible way in the pre-honed bore, on the tool body of the honing tool several guide bars are formed. These guide bars are axially spaced apart relative to the honing stones so that the guide bars center the honing tool in the cylindrical part of the pre-honed bore and, at a certain spacing thereto, another part of the initially cylindrical bore is conically widened.

It is possible that the guide bars and/or the honing stones are radially feedable. Then, a best-possible guiding of the honing tool in the bore and the desired widening of the bore can be achieved.

The feed action of the honing stones is realized in that on the shells feed ramps are formed and in that these feed ramps are interacting with a feed cone.

Alternatively, it is possible that the honing stones are rigidly connected with the shells or are connected pendulously with the shells. Due to the pendulous support of the honing stones on the shells, an even better contact of the honing stones on the surface of the bore to be machined is achieved. Despite of this, canting of individual honing stones in the recess of the bore to be machined is prevented.

In order to be able to monitor and control the process of conical widening during machining, air gauging nozzles are arranged on the honing tool. These air gauging nozzles can be preferably integrated into a guide bar. This simplifies the manufacture and it makes it possible, independent of the honing stones and their wear, to detect the geometry and dimensions of the conically widened bore.

The method according to the invention for widening the bore comprises the steps of: placing the honing stones of the honing tool against the bore, honing the bore with decreasing stroke, wherein a lower reversing point UP of the honing tool remains substantially unchanged. This means that the part of the bore which is located at the lower reversing point UP of the honing tool is machined more frequently by the honing stones than the areas of the bore that are more remote from the lower reversing point UP. Therefore, here the increase of the diameter is greater than in the area of the upper reversing point. As a result, the initially cylindrical bore widens more and more toward the lower reversing point. Honing of the bore with decreasing stroke is terminated according to the invention as soon as the upper reversing point OP has reached a predetermined OP2 (OP=OP2).

It has been found that in this way an initially cylindrical bore can be converted to a slightly conical bore in sections thereof. The method according to the invention can be designed to be very simple and reliable and is possible in this context to produce a bore whose contour line is approximated to a truncated cone in sections thereof.

Alternatively, widening of a part of the cylindrical bore can also be performed by a method for making conical a cylindrical bore in areas or sections thereof that comprises the following steps:

Placing the guide bars of the honing tool against the bore to be machined, conically honing a part of the bore wherein a feeding force with which the honing stones are forced against the bore is controlled as a function of a position of the honing tool in the bore.

With this method, a good action of making conical or widening of the initially cylindrical bore is also achieved. It has been found to be advantageous when the feeding force increases with increasing spacing of the honing tool from a reversing point. It is possible that the feeding force increases linearly, progressively, or even degressively with increasing spacing of the honing tool from a reversing point. In this way, it is possible to compensate effects that lead to a deviation from the desired truncated cone-shaped form of the bore. However, it is also possible to create targeted deviations from a geometric ideal truncated cone shape. For example, the bore in the area of the lower reversing point can be particularly wide in regard to the diameter so that the bore produced according to the method of the invention is widened—greatly exaggerated—like the bell of a trombone. A stiffness of the bore wall which changes locally across the length of the bore can be compensated by a locally changing feed action.

It has further been found to be advantageous when the feed action of the honing tool is realized only when the honing tool is in the vicinity of the lower reversing point UP. The lower reversing point is the area of the bore which has the greatest diameter after performing the method according to the invention. The feed action of the honing tool can only be carried out, for example, when the honing tool is located between the predetermined terminal value UP2 and the lower reversing point UP. OP2 is the point within the travel stroke which is met for all continuously shortened strokes. Within the travel OP2-UP the honing tool is incrementally fed. OP2 is thus the stroke position of the upper reversing point of the smallest stroke and thus also of the last stroke of the machining cycle. This spacing OP2-UP is the smallest commonly traveled travel interval all strokes. Accordingly, the honing stone for each stroke is fed uniformly independent of its length.

These embodiments of the method according to the invention have the advantage that firstly the feed action over the entire honing process is independent of the stroke of the honing tool and therefore can be controlled well with respect to control technology Also, it leads to an improved geometry of the finish machined conical bore because "collapse" of the bore in the area of the lower reversing point UP can be prevented as much as possible. In this way, a "bottle shape" of the bore with two cylindrical sections and a short truncated cone-shaped intermediate area can be avoided.

The method according to the invention for producing a largely truncated cone-shaped bore from an initially cylindrical bore can be integrated in mass production in a process chain for form machining of cylindrical bores wherein this process chain comprises pre-honing of the bore. In this context, a first honing tool or first honing stones of a honing tool can be used. Pre-honing of the bore has the task of manufacturing a completely cylindrical bore with uniform size and uniform surface and of achieving a very good geometric precision of the bore.

In the next step, the non-cylindrical forming of the bore, for example, with a cylindrical and an adjoining conical bore section, is carried out.

In a further step, the bore, made conical, is finish honed so that the desired surface quality and property of the conical bore is reached. This can also be done in a multi-step process as plateau or spiral slide honing in a tool with appropriate separation of the cutting action. In this context, basic roughness depth and plateau roughness depth can be generated as superimposed profile structure. Further advantages and advantageous embodiments of the invention can be taken from the following drawings, their description, and the claims.

BRIEF DESCRIPTION OF THE DRAWINGS

It is shown in.

DESCRIPTION OF PREFERRED EMBODIMENTS

Figure 1:
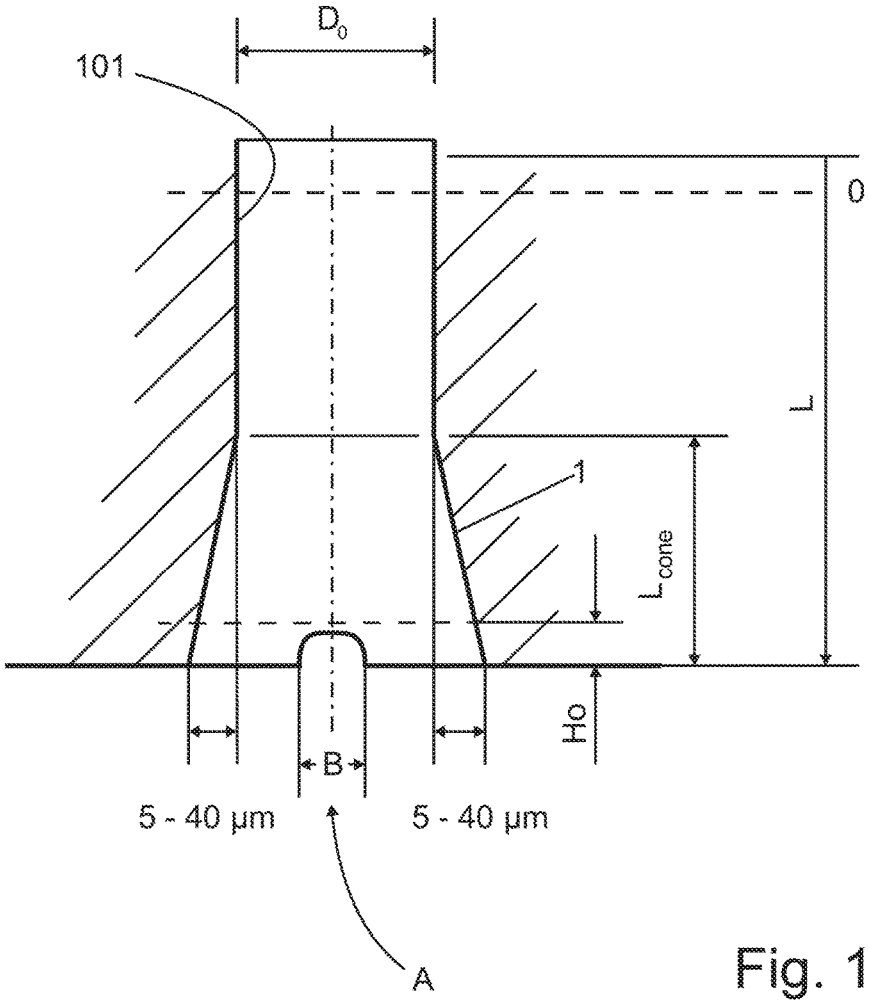
FIG. 1: a schematic illustration of an initially cylindrical bore that by means of the method according to the invention has been made conical.

In FIG. 1, a cylinder bore with a diameter $D_0$ and a bore length L is schematically illustrated.

The diameter $D_0$ refers to the diameter of the cylindrical "top" end of the bore. The bottom end of the bore is conically widened by approximately 15-40 micrometer in radial direction.

At the bottom end of the cylinder bore a recess A with a height $H_0$ and a width B is indicated.

The object of the method according to the invention is to manufacture a bore which at the bottom end has at least one recess A with the width B and at least thereat is conically widened and thereat has a diameter greater than $D_0$.

The contour line of the conically honed bore is identified by 1 in FIG. 1. In principle, it is true for all Figures that same reference characters are used for the same components or processes and only the differences are explained, respectively.

Figure 2:
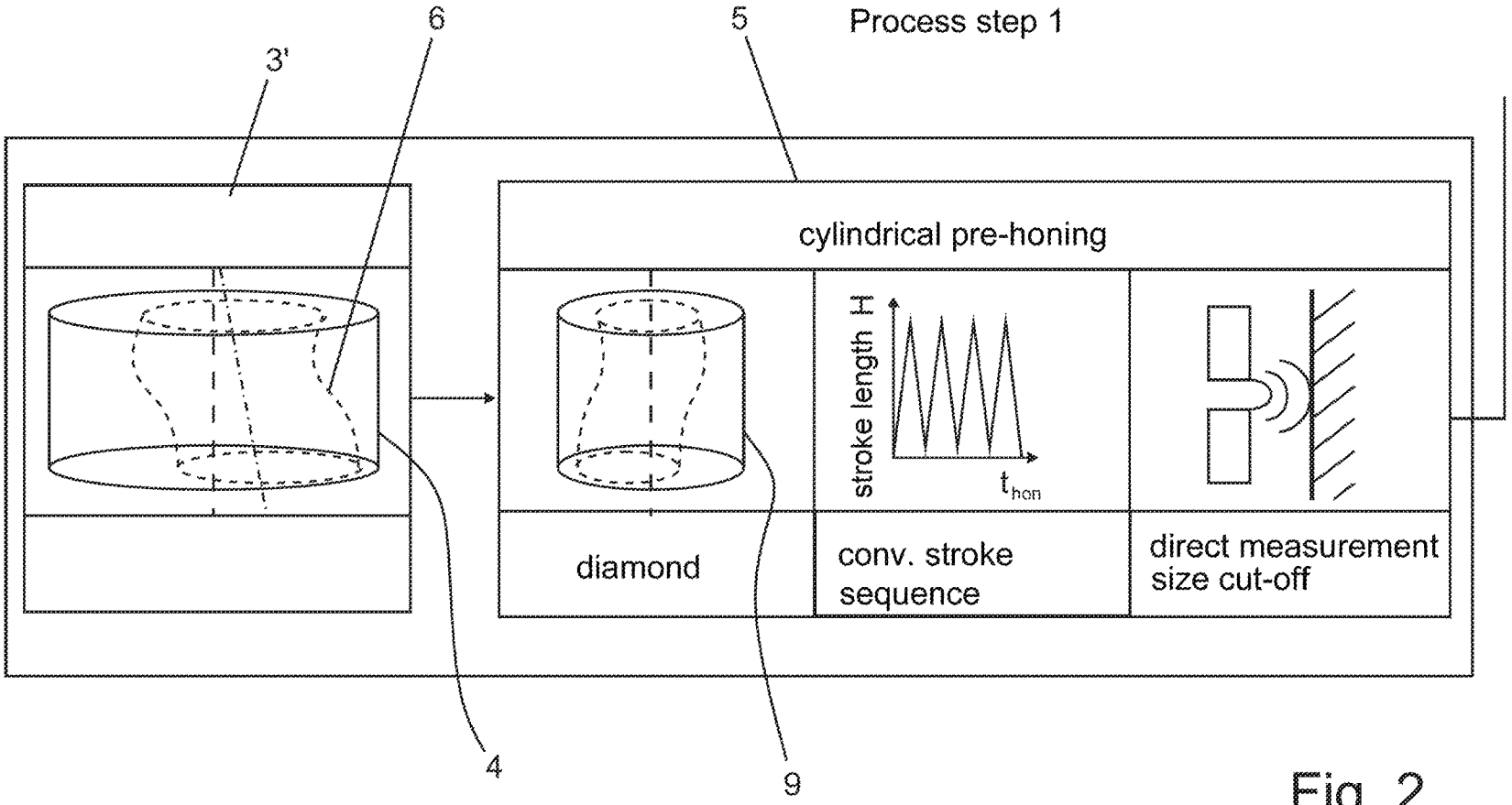
FIG. 2: the first process step "cylindrical pre-honing"

In FIG. 2, preparation of the bore for the widening according to the invention or conical honing is schematically illustrated. The bore to be machined must be prepared so that this machining process can be performed reproducibly, quickly, and inexpensively. In a machining step which is carried out prior to the actual process chain, a bore is introduced into the workpiece. This can be realized, for example, by fine boring, rough honing, or pre-honing. This process step is indicated in FIG. 2 by the reference character 3'. The desired cylindrical bore is indicated in the block 3' by the lines 4. The blank in which the bore is introduced is indicated by dashed lines 6.

In a block 5, the first process step of the process chain according to the invention is schematically illustrated. This first process step is also referred to in the following as "pre-honing". It concerns a conventional honing process by means of which the afore described cylindrical bore produced beforehand by fine boring is further improved with regard to geometry, diameter, and surface. Pre-honing can be carried out with a conventional honing tool whose honing stones are furnished, for example, with diamond as abrasive material. The stroke for cylindrical pre-honing is constant. This fact is shown in the central part of the block 5 by a diagram which illustrates the stroke length H across the honing duration $t_{hon}$. The cylindrical pre-honing is terminated as soon as an in-process measurement has detected that the nominal value of the bore diameter has been reached.

After the end of the first process step "cylindrical pre-honing", a bore is thus provided whose geometry corresponds very precisely to a cylinder. Also, all cylinder bores in a series production exhibit a very similar surface structure and the diameter of the bores of one series have only a very minimal variance. This makes it possible to carry out the following process step, "conical honing", with a minimal series variance and reproducible results in an efficient and reliable way.

Figure 3:
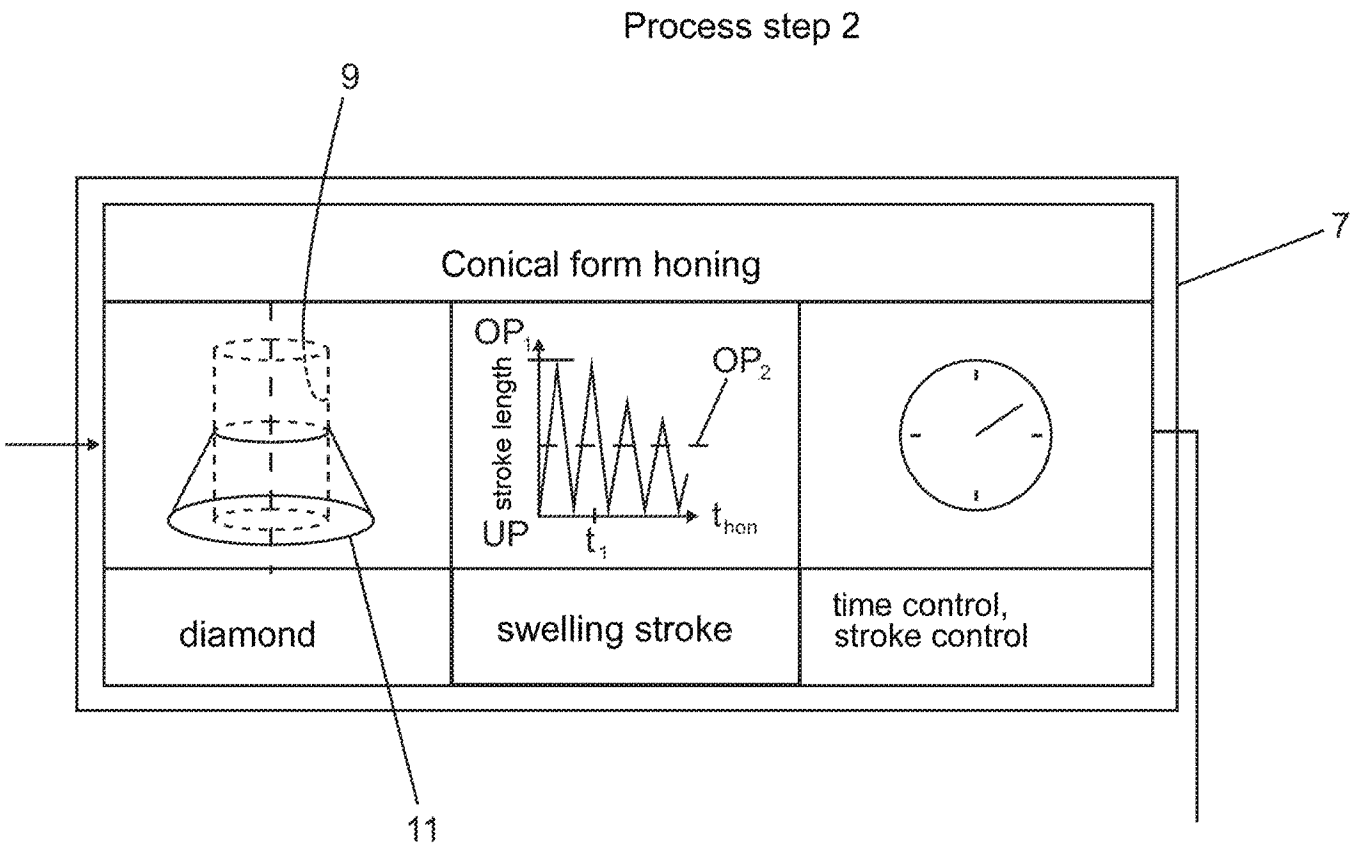
FIG. 3: the first alternative of the second process step "conical form honing"

In principle, it is possible to make conical the bore in two different ways in accordance with the invention. In FIG. 3, a first alternative of the second process step "conical honing" is illustrated in a block 7. In the left part of the block 7, the transition from the cylindrical bore 9, illustrated in dashed lines, into the desired conical bore 11 is shown schematically and greatly exaggerated. At the center of the block 7, the temporal sequence of the second process step "conical honing" is schematically illustrated. In this context, the stroke length H of the honing tool is plotted against the time t. Each stroke of the honing tool has two reversing points, i.e., a lower reversing point UP and an upper reversing point OP. The maximum stroke length $H_{max}$ traveled in the second process step is determined in block 7 by the upper reversing point OP1 and the lower reversing point UP. The maximum stroke length $H_{max}$ determines the length of the conically widened portion of the bore at the bottom end thereof.

The second process step begins with one or a few strokes with constant stroke length wherein the stroke length H is the travel from OP1-UP. At the point in time $t_1$ when the honing stones have contacted the bore to be machined, which at this point in time is still cylindrical, the stroke length H is reduced stepwise. It is a characteristic feature of the method according to the invention that a reversing point, preferably the lower reversing point UP, remains unchanged and the upper reversing point OP is reduced step-by-step until a predetermined limit value OP2 is reached. Thereafter, the process step 2 ends.

Control of the stroke H of the honing tool by an incremental reduction of the stroke length with identical lower reversing point UP has the result that the bore at its bottom end is provided with the desired truncated cone-shaped or a conical contour surface.

The method according to the invention is very precise and requires only little time because, when the predetermined limit value OP2 for the upper reversing point is reached, the honing operation is terminated.

This is an important advantage in comparison to the method disclosed in DE 10 2013 204 714 A1. Here, a conventional machining phase still follows which is characterized by a constant stroke at reduced stroke length.

It has been surprisingly found that with the method according to the invention, that comprises in the end only two stages, a very good quality of bores made conical or of conical bores can be produced in a short period of time.

The second process step according to the second alternative illustrated in FIG. 3 is either performed with time control or as a function of the number of the performed strokes of the honing tool.

Figure 4:
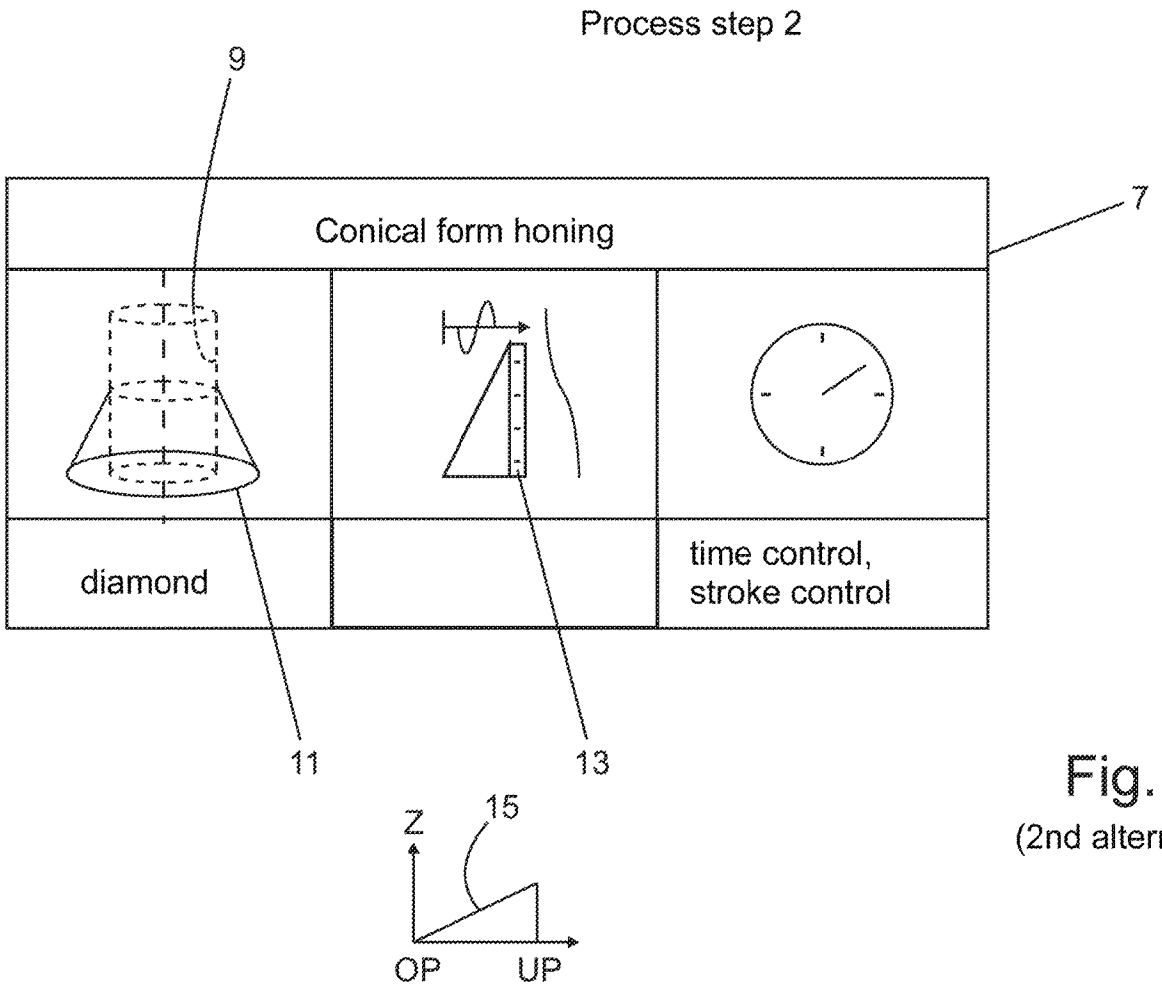
FIG. 4: the second alternative of the second process step "conical form honing"

In FIG. 4, a second alternative of the second process step 7 "conical honing" is illustrated.

In this second alternative of the second process step 7, the feed action of the honing stones 13 is realized as a function of the position of the honing tool in the bore to be machined.

This means that at the top end of the bore, in the vicinity of the upper reversing point OP 1, the honing stones are fed less far than at the lower reversing point UP. This relationship is illustrated in a diagram in which the feed action Z is illustrated as a function of the position of the honing tool in the form of a line 15 (=line through origin). This linear correlation is of course only exemplary. It is also possible to predetermine a progressive or degressive correlation between feed action Z and the position of the honing tool between upper reversing point OP and lower reversing point UP and to control the feed action of the honing tool accordingly.

It is also possible to change the characteristic line of feed action during machining. In this way, it is possible to make the load of the honing tool 13 more uniform and to avoid excessive stress.

The second process step 7 can thus be performed with time control (see FIG. 3) or stroke control (see FIG. 4).

For both alternatives it is possible to hone not only conical bores; it is instead also possible to generate a bottle shape of the bores and, as needed, to carry out counterboring of the cylindrical bore at the top end of the bore and/or at the bottom end of the bore.

The second alternative requires a honing tool that is suitable for form honing and that enables the position-dependent feed action of the honing stones.

Figure 5:
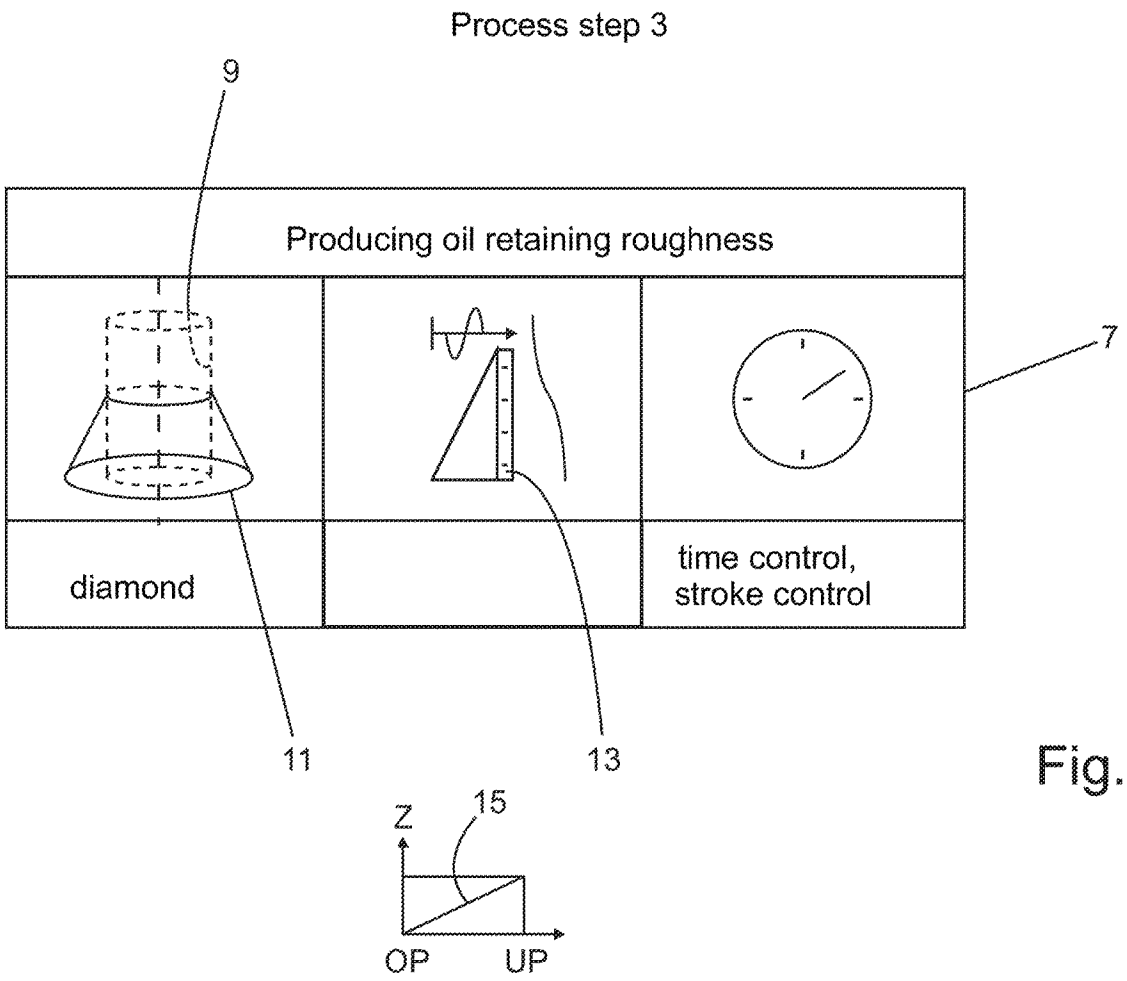
FIG. 5: the process step 3.1 "producing the oil retaining roughness"
Figure 6:
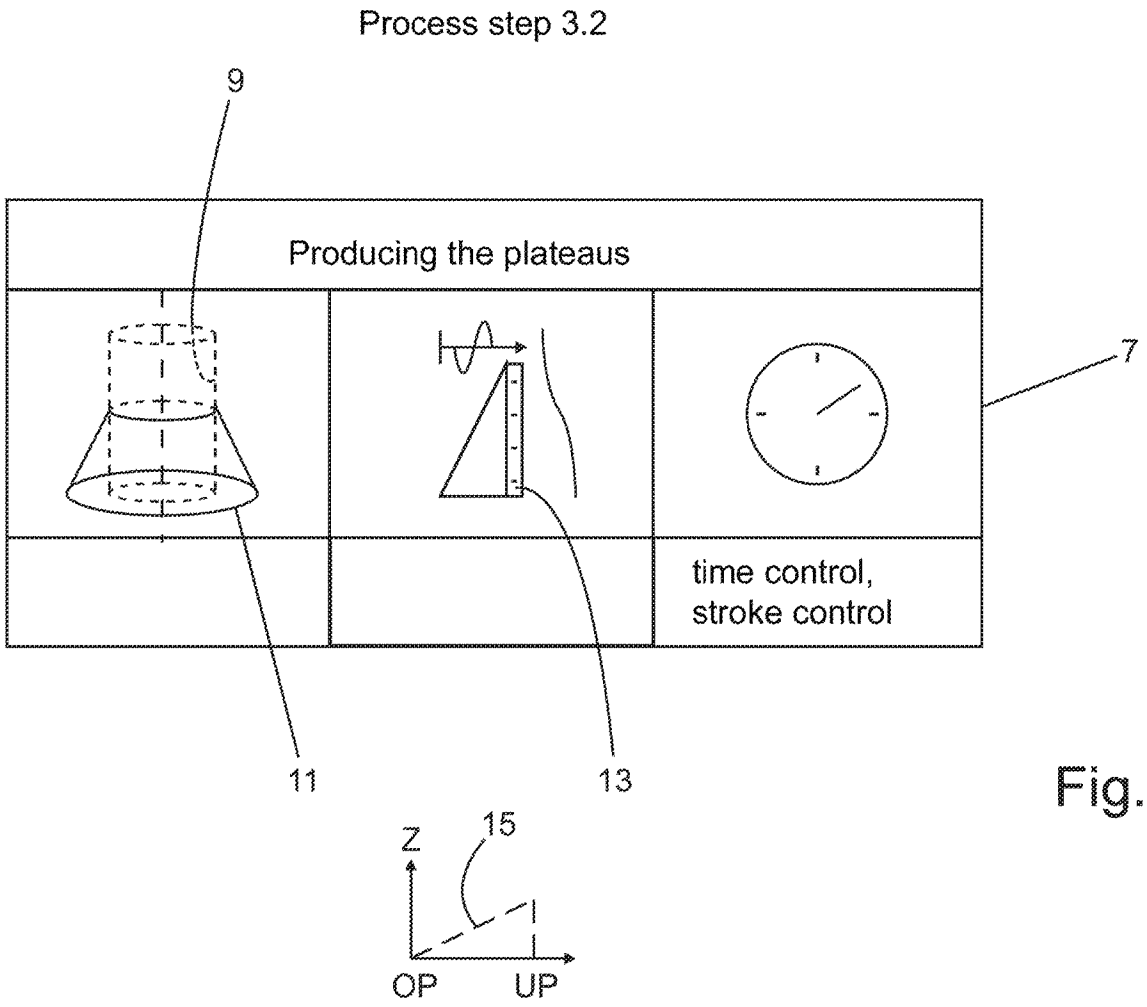
FIG. 6: the process step 3.2 "producing the plateau"

In FIGS. 5 and 6, the third processing step "plateau honing" is illustrated. Plateau honing comprises two partial steps, i.e., "producing the oil retaining roughness" (partial step 3.1) and "producing the plateau" (partial step 3.2).

The feeding force which results from feed action "Z" is constant across the stroke in both partial steps 3.1 and 3.2, respectively. However, in "producing the oil retaining roughness" (partial step 3.1) a greater feeding force is employed than in "producing the plateau" (partial step 3.2). When "producing the oil retaining roughness" (partial step 3.1) or both partial steps 3.1 and 3.2 are carried out with a high stroke speed, then the honing structures are positioned at an acute angle relative to each other and one speaks then of spiral slide honing. This type of producing the oil retaining roughness is also encompassed by the partial step 3.1. The partial steps 3.1 and 3.2 can be realized with the position-dependent feed action as well as with individual spring-loaded honing stones. In both cases, an equidistant guiding of the honing stones is realized relative to the truncated cone-shaped bore formed beforehand in step 2.

Further details of the process control are disclosed in the later published DE 10 2015 209 609 of the same applicant. Reference is being had herewith to this application and the contents of this application is incorporated by reference into the contents of the present application.

Figure 7:
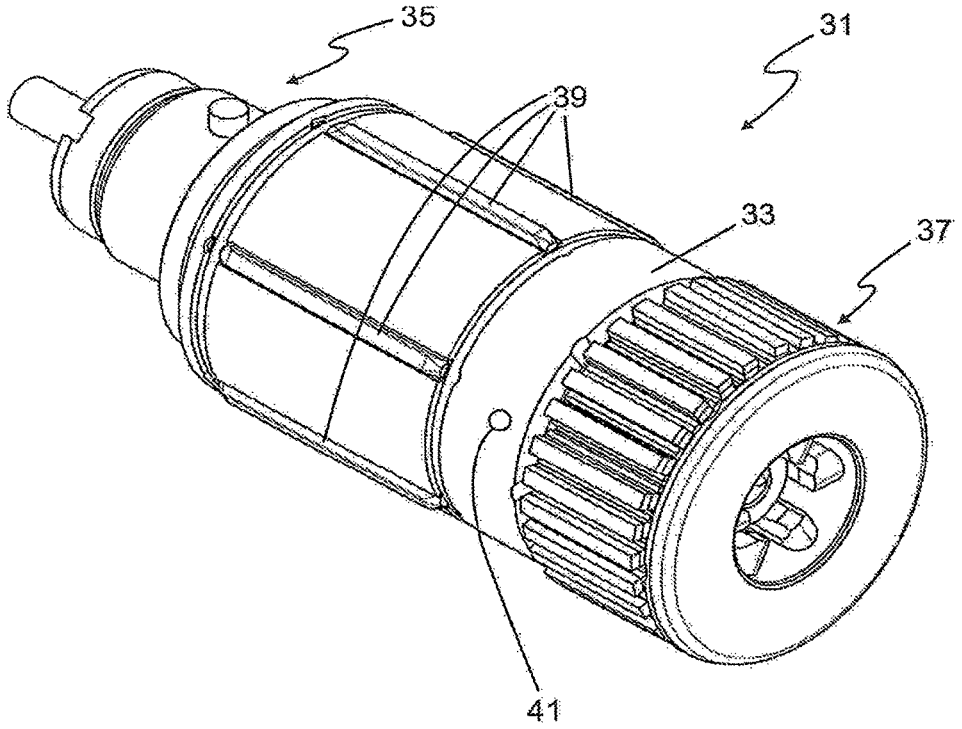
FIG. 7: an isometric illustration of a honing tool according to the invention for performing the second process step.

FIG. 7 shows an embodiment of a honing tool 31 according to the invention in a perspective illustration in detail.

The honing tool 31 comprises a honing body 33 and a receptacle 35 with which the honing tool 31 can be coupled to a spindle, not illustrated, of a conventional honing machine.

The connection of the honing tool 31 with the spindle can be realized, for example, by a double joint (cardanic) drive rod. A rigid connection between the honing tool 31 and the spindle is possible also. In a vertically operating honing machine, the cardanic connection to the spindle is preferred. In a horizontally operating honing machine, the rigid connection is preferred.

The honing machine can be designed, for example, with a conventional double feed system wherein the cutting rates and radial feed positions for different honing methods (e.g., plateau honing, spiral slide honing or conventional honing) can be automatically controlled.

In conventional honing process (also referred to as oscillating honing), honing is performed by rotation of the honing tool 31 with multiple stroke repetitions.

For widening the bottom end of a cylindrical bore (see FIG. 1) in accordance with the second step of the process chain according to the invention, a cutting bar group 37 is provided on the honing tool 31. The honing stones of the cutting bar group 37 are relatively short in axial direction. In this way, widening of the bottom end of the cylindrical bore (see FIG. 1) is facilitated or is even made possible in this way.

The honing tool 31 according to the invention exhibits the special feature that several honing stones 37 are arranged on a shell, respectively, and are fixedly connected to it. This will be explained in more detail infra in connection with FIG. 9.

The honing tool 31 comprises also the guide bars 39. The guide bars 39 center the honing tool 31 in the cylindrical (top) part of the bore (see FIG. 1).

The guide bars 39 are comprised of metallic material, e.g., hard metal or of sintered diamond coatings which either have a wear-resistant smooth surface or have a rough, cutting, machining, surface. Then the guide bars 39 at the same time also act as honing stones for the cylindrical part of the bore.

The guide bars 39 and the honing stones 37 are arranged in axial position in sequence and so as not to overlap. As an alternative to the illustrated honing stones 37, the shells can be provided across the entire surface area with abrasive material, for example, diamond grains, by means of galvanic bonding.

The guide bars 39 can be radially fed in order to achieve a play-free contact on the cylindrical part of the bore to be machined. In this way, a very good centering action of the tool 31 in the bore across a great axial length is achieved. As a result of this, a very good coaxial alignment of conical (bottom) and cylindrical (top) part of the bore is achieved.

It is also possible to attach the guide bars 39 on the tool body 33 so as to be non-feedable. They are then ground to a diameter such that a certain clearance is formed between the pre-processed bore and the guide bars 39.

In this way, a guiding of the honing tool 31 in the bore is achieved also, in particular with the precision of the clearance between the guide bars and the pre-machined bore.

The clearance between the guide bars 39 and the pre-machined bore has an effect on the quality of guiding of the honing tool 31 in the bore.

The guide bars 39 are longer than the honing stones 37. In this way, a constant good guiding action of the honing tool 31 during the second processing step 2 "conical form honing" is ensured.

The tool receptacle 35 is preferably of a double joint configuration, so that the honing tool 31 can center itself and align within the bore when the guide bars 39 are moved radially outwardly into contact at the cylindrical part of the bore. However, also rigid tool receptacles and tool receptacles with only one joint have been tested successfully.

It has been found to be advantageous to provide at least one air gauging nozzle 41 in the tool body 33 and between honing stones 37 and guide bars 39 in axial direction. These air gauging nozzles 41 enable in-process measurement of the developing conical shape of the bottom part of the bore.

Honing can be done with the swelling stroke or with the dynamic EMF within the axial working range of the shells or of the honing stones where the conicity is produced.

Figure 8:
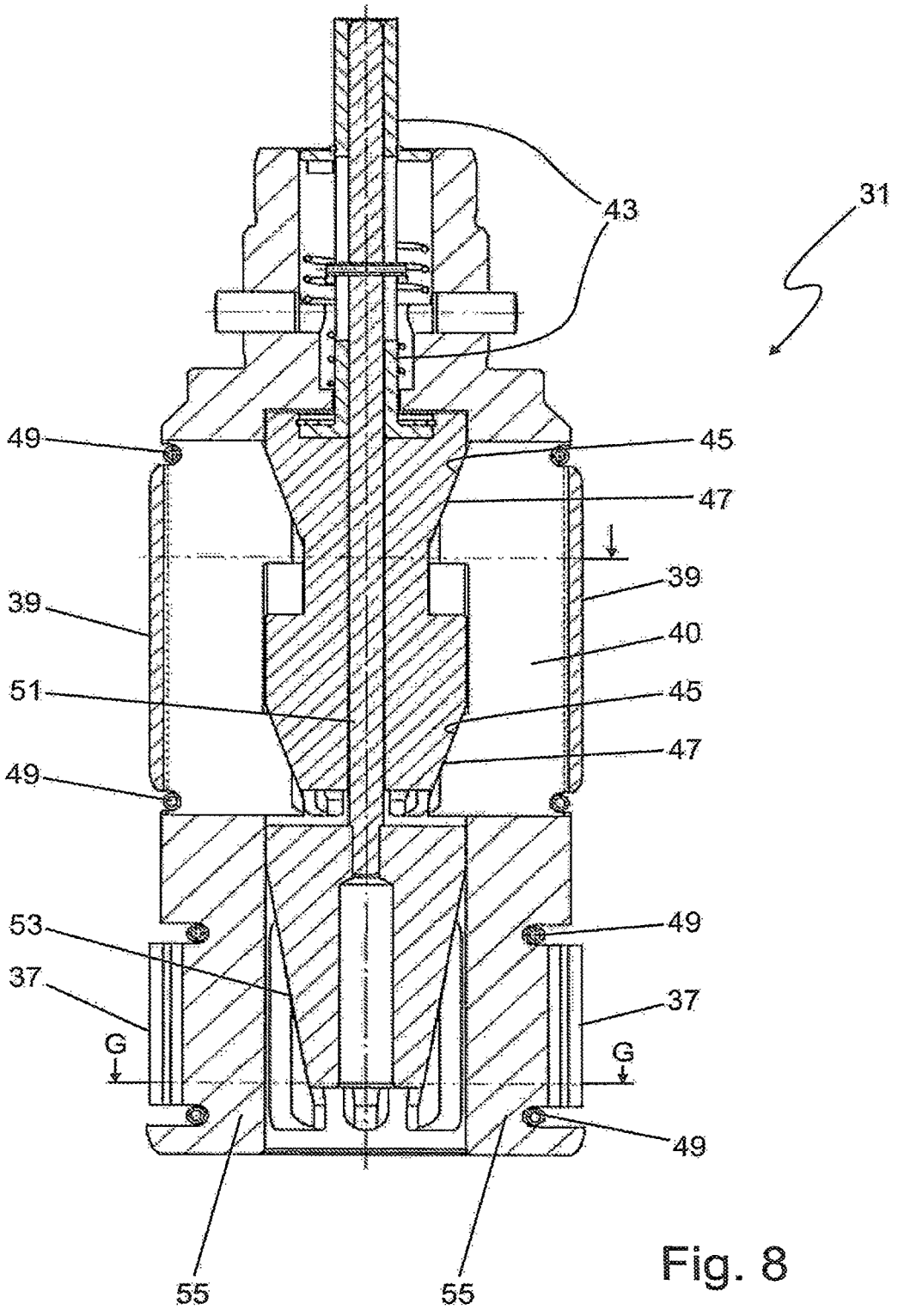
FIG. 8: a longitudinal section of the honing tool of FIG. 7.

FIG. 8 shows a section of the tool 31 in which the expandable guide bars 39 are recognizable. In this context, a feed tube 43 actuates two groups of feed cones 45 which move the guide bars 39 radially in outward direction when the feed tube 43 in FIG. 8 is moved downwardly relative to the tool 31. The guide bars 39 are mounted on support bars 40 which at their radial inner "end" have two conical feed surfaces 47 which are spaced apart from each other. These feed surfaces 47 interact with the feed cones 45 in a generally known manner.

Springs 49 secure the guide bars 39 as well as the honing stones 37 against falling out.

Feeding of the honing stones 37 is realized similar to feeding of the guide bars 39. A feed rod 51 is guided through the feed tube 43. It is connected to a feed cone 53. When the feed rod 51 in FIG. 8 is relatively moved in the tool 31 in downward direction, the honing stones 37 are fed radially in outward direction. The conical feed surfaces 57 (see FIG. 9) of the honing stones 37 which are located on honing shells 55 and are interacting with the feed cone 53 are not visible in the longitudinal section according to FIG. 8.

This type of feed action is known to any person of skill in the art and therefore requires no detailed explanation.

Figure 9:
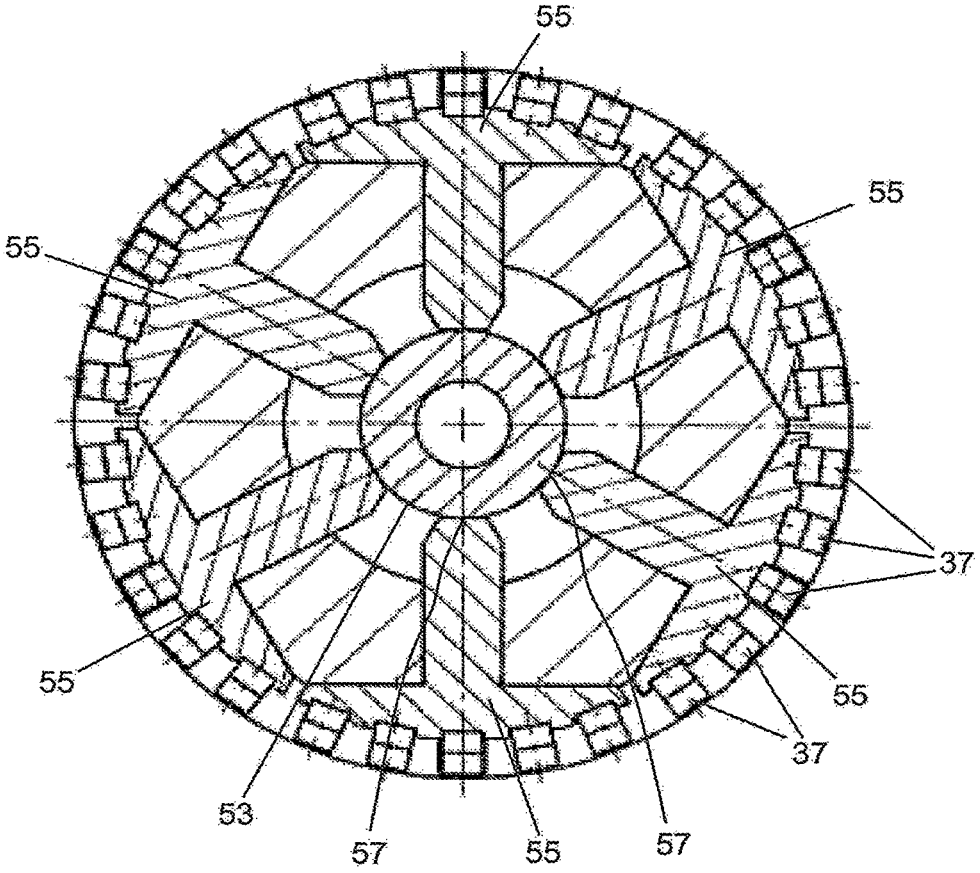
FIG. 9: a cross-section of the honing tool of FIG. 7 at the level of the honing shells.

In FIG. 9 a cross section of the tool 31 along the line G-G is illustrated.

This illustration shows the feed cone 53 well. Since the feed cone in the area of the section plane is bored hollow, the feed rod 51 is not visible. Well illustrated are a total of six shells 55 uniformly distributed about the circumference which each support five honing stones 37.

For reasons of clarity, the five honing stones 37 only on one shell are provided with reference characters.

Radially inwardly, conical feed surfaces 57 are extending which interact in a generally known way with the feed cone 53. The shells 55 are rigid so that therefore also the five honing stones 37 arranged on a shell 55 are positioned fixedly relative to each other.

In the present embodiment, six shells 55 are present so that the five honing stones 37 arranged on a shell 55 cover approximately a circumferential angle of 60°.

When now this circumferential angle of approximately 60° is correlated with the width B of the recess A in FIG. 1, it is apparent that the circumferential area which is covered by the five honing stones 37 must be greater than the width B of the recess A in FIG. 1. Then it is ensured that always at least one honing stone 37 of a shell is not located in the area of the recess A but is guided on the bore wall. As a result of this, due to the rigid connection of the five honing stones 37 by the shell 55, the other honing stones which are positioned across the recess A are also secured against canting.

Accordingly, by means of the tool according to the invention it is possible to conically widen a cylindrical bore in sections thereof even when in the area in which conically widening is to take place a recess is located which would make difficult guiding of the honing stones 37.

The conical widening by means of the tool according to the invention is as efficient as other methods known in the prior art for widening bores without recesses.

The tool according to the invention is also not more expensive in its manufacture because significant cost advantages result by combining several honing stones on a shell 55.

Figure 10:
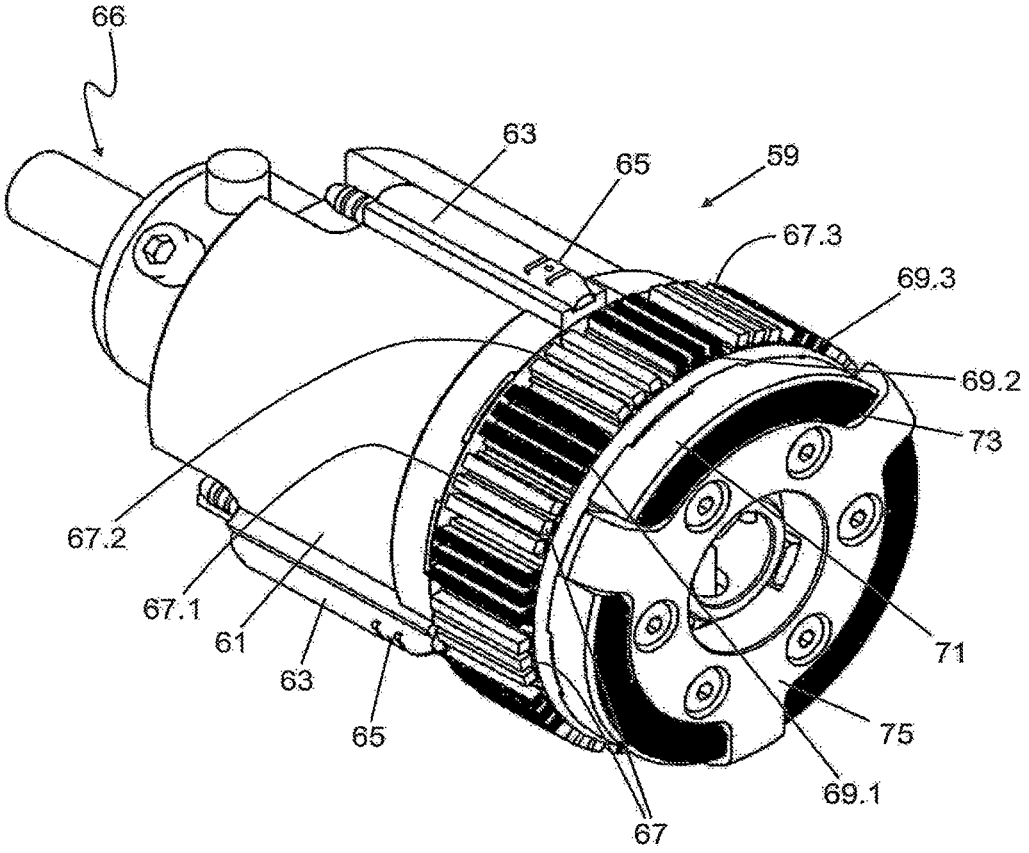
FIG. 10: the honing tool with double feed action for performing the third process step "plateau honing"

In FIG. 10, a honing tool 59 is illustrated that is suitable for performing the third process step, i.e., honing of the area of the bore that has been previously made conical or widened. Use of this tool 59 independent of the described process chain is possible also. The preferred use concerns machining of bores with recesses A in the bore to be machined. Depending on the employed feed mode or stroke mode, cylindrical, truncated cone-shaped or conical bores can be produced or further processed.

In a tool body 61 guide bars 63 are arranged. In the guide bars 63 air gauging nozzles 65 are integrated. The air gauging nozzles 65 are arranged at the bottom end of the guide bars 63 which is opposite the receptacle 66. In other words: The air gauging nozzles 65 are located in immediate vicinity of the honing stones 67 and 69.

In the illustrated embodiment, three honing stones 67 and three honing stone 69 are combined to a group, respectively. The honing stones 67 and 69 alternate about the circumference of the honing tool 59. In axial direction, the honing stones 67 and 69 are positioned at the same level, i.e., below the guide bars 63.

The honing stones 67 and 69 are coated with different abrasive materials because they effect the two partial steps of plateau honing, i.e., the partial step 3.1 (see FIG. 5 "producing the oil retaining roughness") and the partial step 3.2 (see FIG. 6 "producing the plateau").

In order to prevent canting of the groups of honing stones 67 or 69 upon traveling across the recess A (see FIG. 1), at least two groups 67.1 or 67.2 are arranged on a shell. The same holds true also for the second group of honing stones 69.1 or 69.2.

It is also possible that three groups of honing stones 67 are arranged on a common shell and correspondingly also three groups of honing stones 69.3 are arranged on a shell.

Important in connection with the invention is that canting of the honing stones 67 or 69 is avoided in this way, similar to the honing tool according to FIGS. 7 and 8.

FIG. 10 illustrates well the shells 71 which support the honing stone groups 67.1, 67.2, and 67.3.

Coaxially arranged thereto is a further shell 73 which supports the honing stone groups 69.1, 69.2, and 69.3.

Against rotation and loss, the shells 71 or 73 are secured by an end member 75 which is screwed to the tool body 61. As a whole, distributed about the circumference there are three shells 71 and three shells 73 and correspondingly nine honing stone groups 67 and nine honing stone groups 69. For reasons of clarity, only one shell 71 and 73 as well as three honing stone groups 67.1, 67.2, and 67.3 as well as 69.1, 69.2 and 69.3 are illustrated in FIG. 10.

Figure 11:
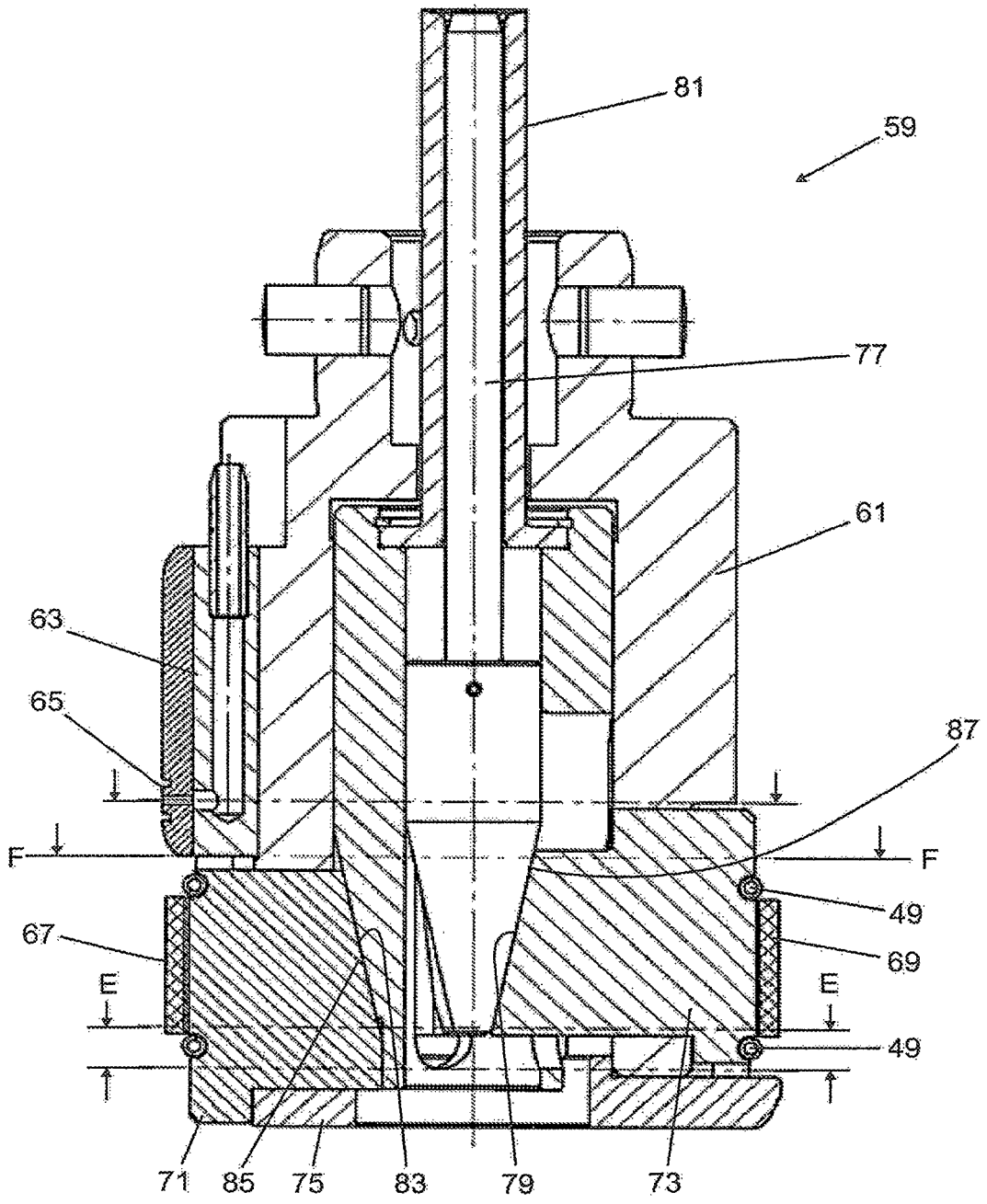
FIG. 11: a longitudinal section of the tool of FIG. 10.

In FIG. 11, a longitudinal section of the tool 59 according to FIG. 10 is illustrated.

This tool also has a double feed action for the shells 73 and for the shells 71, respectively. The feed rod 77 and the feed cone 79 are surrounded by a feed tube 81 as well as a further feed cone 83. The feed cones 79 and 83 interact with complementary feed ramps 85 of the shells 71 as well as a feed ramp 87 of the shells 73 in a generally known way.

As can be seen in FIG. 11, the honing stones 67 and 69 are at the same level. However, in FIG. 11 the shells 73 project less far in downward direction than the shells 71. At the same time, the shell 71 begins in axial direction father downward than the shell 73. In this way, it is possible to provide a penetration or cutout for the respective other shell so that the shells 73 with their correlated feed ramps 87 reaches the feed cone 79 and the shells 71 with reaches with their feed surfaces 85 the feed cone 83.

Figure 14:
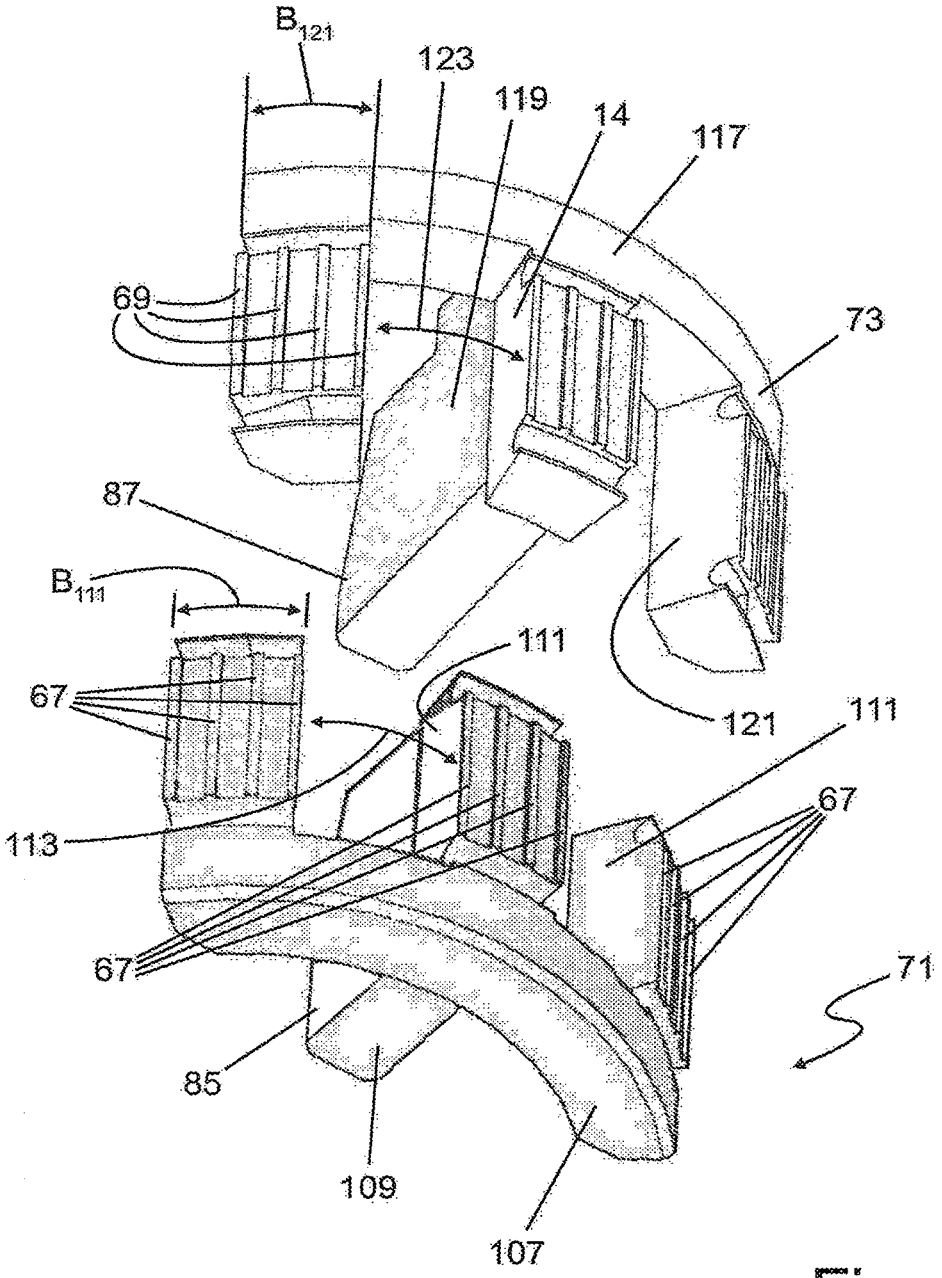
FIG. 14: an isometric illustration of the comb-like embodied shells according to the invention.
Figure 15:
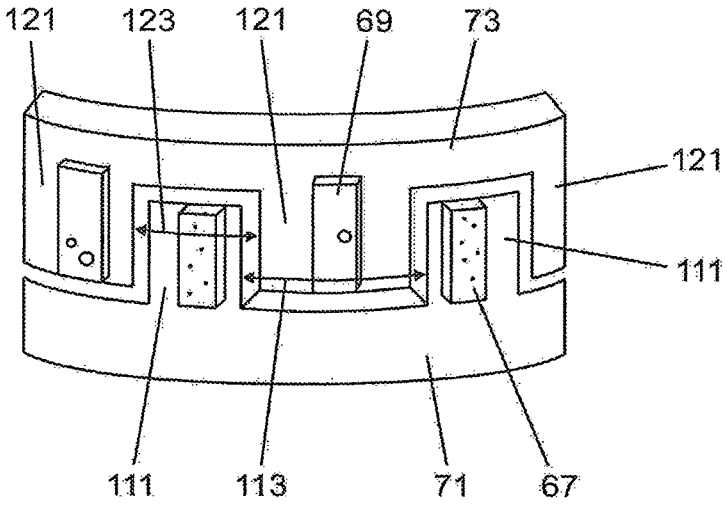
FIG. 15: a schematic illustration for illustrating the meshing of the shells according to the invention.

Here also, the honing stones 67 and 69 are secured by spring rings 49 in contact against the feed cone 79 or 83. In FIGS. 14 and 15, the shells 71 and 73 and their intermeshing are illustrated.

Figure 12A:
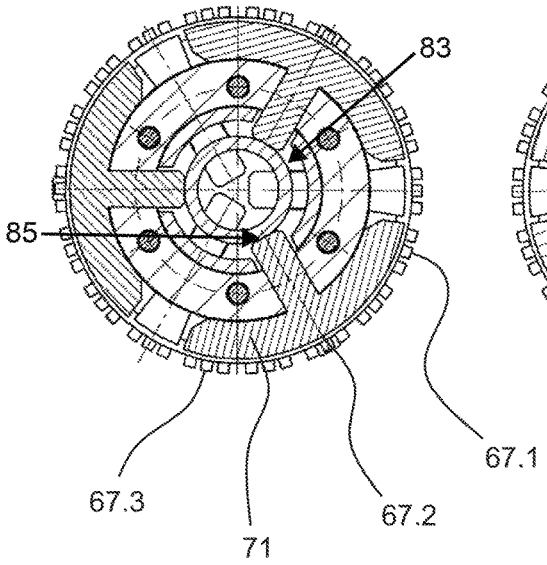
FIG. 12*a* and FIG. 12*b*: cross sections of the tool of FIG. 10 along the lines E-E and F-E.
Figure 12B:
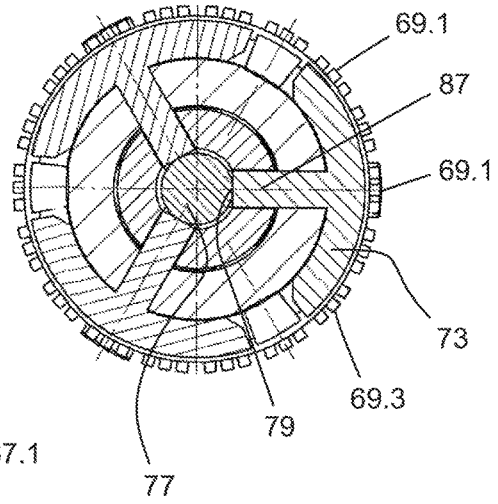

In FIG. 12*a* and FIG. 12*b*, two cross sections of the tool according to FIG. 11 are illustrated.

The section along the line F-F shown in FIG. 12*b* illustrates well the shells 73 which support the honing stone groups 69.1 to 69.3 as well as the feed ramp 87 and the feed cone 79 which is coupled with the feed rod 77.

The section along the line E-E shown in FIG. 12*a* illustrates well the shells 71 which support honing stones 67.1, 67.2, and 67.3. Further, it is illustrated well that radially inwardly, in extension of the shells 71, the feed surfaces 85 interact with the feed cone 83.

The shells 71 as well as the shells 73 cover almost 120° of the circumference so that also for this tool it is ensured that the honing stones 67.1, 67.2, and 67.3 will not cant when they rest above a recess A as illustrated in FIG. 1.

Figure 13:
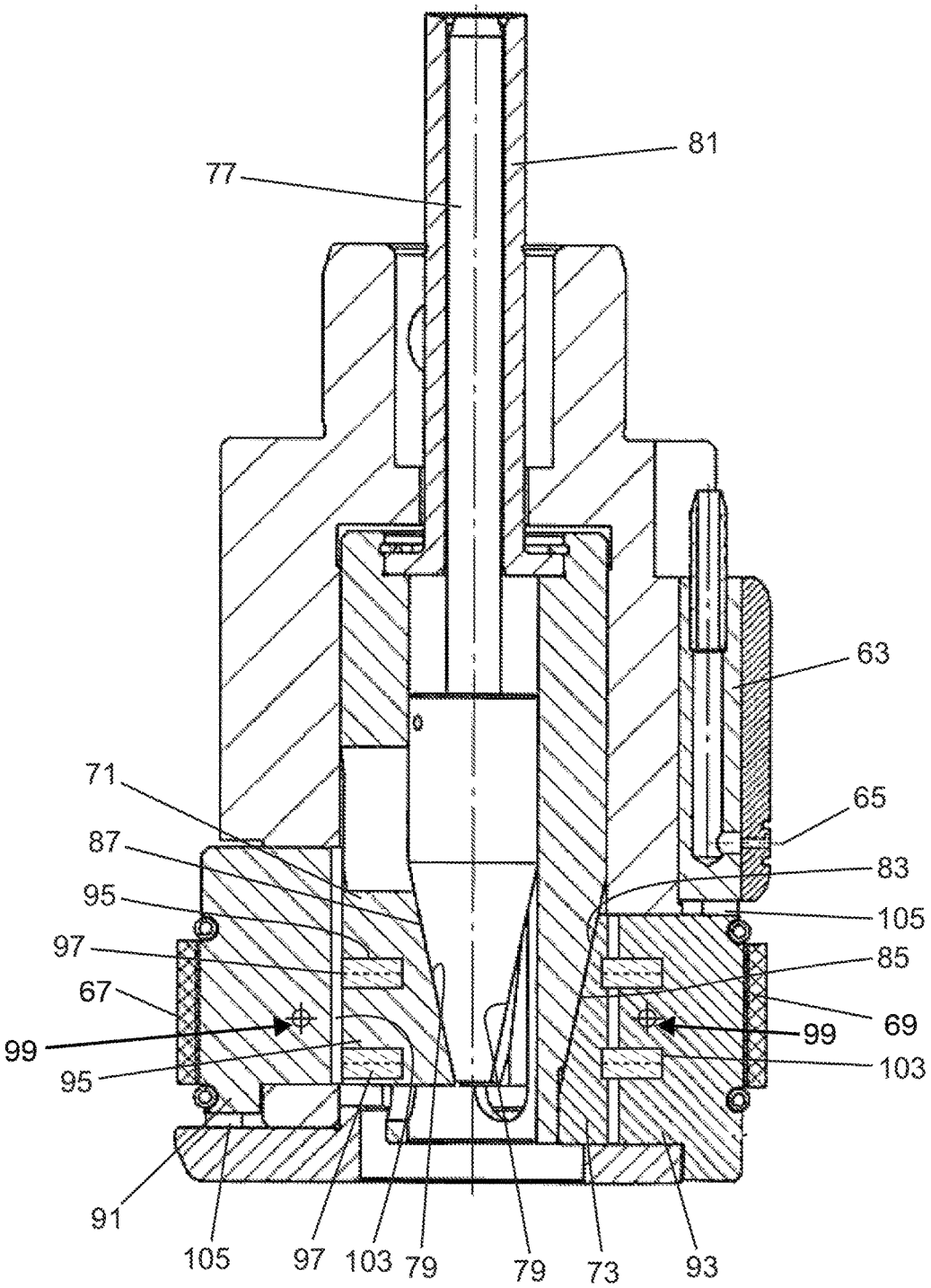
FIG. 13: a variant of the honing tool for plateau honing.

In FIG. 13, a second embodiment of a honing tool 59 according to the invention is illustrated in longitudinal section which is suitable to perform the "plateau honing" with the partial processes 3.1 and 3.2.

The feed rod 77 comprises a feed cone 79 which effects with complementary feed ramps 87 of the shell 71 a radial feed action of the support bars 91 when the feed rod 77 is displaced, for example, by a non-illustrated electromechanical feed action of the honing machine in axial direction relative to the tool body 61. In this embodiment, the support bars 91 support the honing stones 67.

In a corresponding manner, the feed tube 81 is coupled with a feed cone 83 which, together with complementary feed ramps 85 of the the shell 73, effects a radial feed action of the support bars 93 and thus also of the honing stones 69 when the feed tube 83 is controlled appropriately.

FIG. 13 further illustrates well that in the shells 71 and 73 as well as the support bars 91 and 93 two bores 95 are provided, respectively, in which spiral springs 97 are arranged. Two spiral springs 97 each are supported at one end against the base of the bores 95 in the shells 71 or 73 as well as with the other end in the support bars 91 and 93. On the radially outwardly arranged area of the support bars 91 and 93, the honing stones 67, 69 are attached.

As an alternative to the aforementioned spiral springs, other springs can be used also, for example, also possible are constructions with leaf springs, plate springs, bending joints or with elastically yielding components.

Perpendicular to the drawing plane in FIG. 13, bearing bolts 99 are arranged in the support bars 91 and 93. The bearing bolts 99 interact with grooves 103, hardly visible in FIG. 13, in the feed ramps 85, 87 in such a way that the support bars 91, 93 in axial direction cannot be displaced relative to the feed ramps 85, 87. At the same time, the support bars 91, 93 can perform a pendulous compensation movement whose axis of rotation coincides with the longitudinal axis of the bearing bolt 99. In this way it is possible that the honing stones 67, 69, in accordance with the conicity of the bore 101 to be machined, will become slantedly positioned. As a result of this, the honing stones 67, 69 are forced across their entire length uniformly and with constant force against the cylinder bore 101 to be processed.

In this way, in every area of the cylinder bore the same surface is thus achieved in the end by machining with the honing tool according to the invention.

In order for the support bars 91, 93 not to be forced as a result of the force of the spiral springs 97 radially outwardly out of the tool body 61, a frame 105 is screwed on radially outwardly on the feed ramps 85, 87.

The construction of these pendulously supported honing stones 67, 69 corresponds mostly to the construction disclosed in patent DE 10 2010 032 453 whose contents is herewith incorporated by reference into the contents of the present patent application.

In this embodiment of a honing tool 59, the guide bars are not feedable.

In FIG. 14, the shells 71 and 73 according to the invention are illustrated in an exploded view.

The shell 71 comprises a circular segment-shaped support 107 and a support bar 109. The support 107 and the support bar 109 are in general manufactured as one piece from a workpiece. It is also conceivable to connect both components to each other by welding or the like.

On the radial inner end of the support bar 109 the feed ramp 85 is located that already has been explained before. The support bar 109 passes into a support element 111 which supports the honing stones 67.

In this embodiment, in addition to the support bar 109 further support elements 111 are formed at the ends of the support 107. The honing stones 67 which belong to the shell 71 are mounted on the support bar 109 or the support elements 111. In the isometric view of FIG. 14, only two support elements 111 are visible; one is covered by the honing stones 67.

Between the support elements 111 or the honing stones 67 arranged thereon, an inner width indicated by the curved double arrow 113 is provided in circumferential direction.

The support 107 is connected at one end of the support bars 109 to the latter so that as a whole a comb-like structure results.

The shell 73 is in principle of the same configuration as the shell 71. The important difference resides in that the circular segment-shaped support 117 is arranged on the end of the support bar 119 that is at the top in FIG. 14 while it is arranged at the bottom end of the support bar 109 in case of the shell 71.

For reasons of clarity, not all honing stones 69 are provided with reference characters.

The inner width 113 between the honing stones 67 is greater than a width $B_{121}$ of the support elements 121 of the shell 73.

In a corresponding manner, an inner width 123 between the honing stones 69 is greater than a width $B_{111}$ of the honing stones 67 of the shell 71. Because the circular segment-shaped supports 107 and 117 of the shells 71 and 73 is arranged at "oppositely positioned" ends, it is possible that the shells 71 and 73 with the comb-like support elements 111, 121 are mounted on the tool body 61 "meshing" with each other (see FIGS. 10 and 11). As a result, the honing stones 67 and 69 are are arranged essentially adjacent to each other on the circumference of the honing tool. This results in a very short constructive length of the honing tool 59. Also, when machining the bore with this honing tool 59, only a very short idle travel of the tool past the end of the bore is required.

In FIG. 15 it is again illustrated how the shells 71 and 73 and their honing stones 67, 69 are meshing comb-like with each other when they are mounted on the honing tool 59 (see FIG. 10). FIG. 15 is a somewhat simplified illustration which however illustrates well the principle according to the invention of comb-like meshing shells 71 and 73. In order to illustrate this principle, the inner widths 113 and 123 are also indicated.

It should be noted that in the honing tool 59 the following combinations are possible:

Variant 1:

shell 71: pendulous support of the honing stones 67 shell 73: pendulous support of the honing stones 69

Variant 2:
shell 71: rigid connection of the honing stones 67
shell 73: rigid connection of the honing stone 69
Variant 3:
shell 71: pendulous support of the honing stones 69
shell 73: rigid connection of the honing stones 69
Variant 4:
shell 71: rigid connection of the honing stones 67
shell 73: pendulous support of the honing stones 69

On the basis of the afore described constructive features of the honing tools according to the invention, the process chain according to the invention can be performed with the following process steps listed once more:

1. Cylindrical pre-honing with conventional honing technology for producing a cylindrical starting state with defined roughness for further bore machining.

2. The second operation machines the cylindrical bore to the desired bore form with a cylindrical section and an adjoining conical section. This can be done with pre-published methods such as swelling stroke or dynamic stepped feed action.

3. The third machining stage characterizes a smoothing operation with which, for example, a spiral slide honing with a plateau profile is generated. As in conventional plateau honing or spiral slide operations, here also a double feed action tool is used. This means that two shell sets with three shells each are furnished with different honing stones and are feedable independent of each other.

In process step 2 the honing tool whose honing stones are arranged on shells are guided in the cylindrical portion of the bore which ensures a coaxial position of the conical part relative to the cylindrical section.

For the third process step, a shell tool is proposed which has two different shell sets which are arranged in the tool body in the same axial position. In this way, coverage of large surface area bore interruptions as well as functionally proper plateau honing with absolutely identical honing angle of is achieved in the partial steps 3.1 "producing the oil retaining roughness" and 3.2 "producing a plateau".

Moreover, the tools for the second and third operations are designed for air gauging so that the resulting conicity can be monitored constantly in the process.

What is claimed is:

1. A honing tool comprising:
a tool body;
shells disposed on the tool body;
honing stone sets each comprising two or more honing stones;
the shells each supporting one of the honing stone sets;
guide bars mounted on support bars that are disposed on the tool body, wherein the support bars comprise conical feed surfaces that interact with complementary feed cones of a feed action of the honing tool.

2. The honing tool according to claim 1, wherein the shells each cover an angle range of more than 20° of a circumference of the honing tool.

3. The honing tool according to claim 2, wherein the angle range is more than 30°.

4. The honing tool according to claim 3, wherein the angle range is more than 50°.

5. A method for producing a bore, conical at least over sections thereof, by a honing tool according to claim 1, the method comprising the steps of:
placing guide bars of the honing tool against the bore;
conical honing a portion of the bore with a decreasing stroke of the honing tool, wherein a lower reversing point of the honing tool remains substantially unchanged;
terminating conical honing as soon as an upper reversing point has reached a predetermined terminal value.

6. A process chain for form machining of cylindrical bores with at least two honing tools, the process chain comprising the steps of:
pre-honing a bore;
making conical a part of the bore according to the method of claim 5;
plateau honing at least the conical part of the bore by producing an oil retaining roughness by honing with a first set of the honing stones with a constant feeding force and by producing a plateau by honing with a second set of the honing stones with constant feeding force.

7. A control device for a honing machine, the control device programmed for applying a method according to claim 5.

8. A method for producing a bore, conical at least over sections thereof, by a honing tool according to claim 1, the method comprising the steps of:
placing guide bars of the honing tool against the bore;
conical honing a portion of the bore with a constant stroke of the honing tool, wherein reversing points of the stroke of the honing tool remain substantially unchanged and wherein a feeding force with which the honing stones are pressed against the bore is controlled as a function of a position of the honing tool in the bore.

9. The method according to claim 8, further comprising increasing linearly, progressively, or degressively the feeding force with an increasing spacing of the honing tool from a reversing point.

10. The method according to claim 8, further comprising applying a feed action of the honing stones only when the honing tool is located in the vicinity of a lower reversing point.

11. The method according to claim 10, wherein the feed action of the honing stones is applied only when the honing tool is located between a predetermined terminal value of an upper reversing point and a lower reversing point.

12. A process chain for form machining of cylindrical bores with at least two honing tools, the process chain comprising the steps of:
pre-honing a bore;
making conical a part of the bore according to the method of claim 8;
plateau honing at least the conical part of the bore by producing an oil retaining roughness by honing with a first set of the honing stones with a constant feeding force and by producing a plateau by honing with a second set of the honing stones with constant feeding force.

13. A control device for a honing machine, the control device programmed for applying a method according to claim 8.

14. The honing tool according to claim 1, wherein the honing stones are radially feedable.

15. The honing tool according to claim 1, wherein the shells comprise feed ramps that interact with a feed cone of the honing tool.

16. The honing tool according to claim 1, further comprising at least one air gauging nozzle.

17. A honing tool comprising:
a tool body;

shells disposed on the tool body;

honing stone sets each comprising two or more honing stones;

the shells each supporting one of the honing stone sets;

wherein the shells each comprise a support, a support bar, and two or more support elements;

wherein the shells include a first shell and a second shell, wherein the support elements and the honing stones of the first shell in a circumferential direction of the honing tool have a spacing relative to each other, wherein the support elements and the honing stones of the second shell in the circumferential direction of the honing tool have a first circumferential width, wherein the first spacing is greater than the first circumferential width.

18. The honing tool according to claim 17, further comprising a plurality of guide bars.

19. The honing tool according to claim 18, wherein the guide bars are radially feedable.

20. The honing tool according to claim 17, wherein the honing stones are radially feedable.

21. The honing tool according to claim 17, wherein the shells comprise feed ramps that interact with a feed cone of the honing tool.

22. The honing tool according to claim 17, wherein the honing stones are connected rigidly to the shells.

23. The honing tool according to claim 17, wherein the honing stones are connected pendulously to the shells.

24. The honing tool according to claim 17, wherein the shells include a plurality of said first shell as a first set of shells and a plurality of said second shell as a second set of shells, wherein the first and second sets of shells are arranged adjacent to each other in a circumferential direction on the tool body.

25. The honing tool according to claim 24, wherein the honing stones of the first set of shells are different from the honing stones of the second set of shells.

26. The honing tool according to claim 25, wherein the honing stones of the first set of shells and the honing stones of the second set of shells alternate in a circumferential direction of the honing tool.

27. The honing tool according to claim 17, wherein the honing stones are arranged on the support elements.

28. The honing tool according to claim 17, wherein the support elements and the honing stones of the second shell in the circumferential direction of the honing tool have a second spacing relative to each other, wherein the support elements and the honing stones of the first shell in the circumferential direction of the honing tool have a second circumferential width, wherein the second spacing is greater than the second circumferential width.

29. The honing tool according to claim 17, further comprising at least one air gauging nozzle.

30. A method for plateau honing of a conical part of a bore with a honing tool according to claim 17, the method comprising the steps of:

producing an oil retaining roughness by honing with a first set of the honing stones with a constant feeding force;

producing a plateau by honing with a second set of the honing stones with a constant feeding force.

31. The method according to claim 30, wherein the feeding force used in producing the oil retaining roughness is greater than the feeding force used in producing the plateau.

* * * * *